United States Patent [19]

Prufer et al.

[11] Patent Number: 4,673,010

[45] Date of Patent: Jun. 16, 1987

[54] INTERNAL EXPANSION WATERBED FITTING

[76] Inventors: Max H. Prufer; James M. Prufer, both of 180 Advance Blvd., Bramalea, Canada, L6T 4J4

[21] Appl. No.: 742,991

[22] Filed: Jun. 10, 1985

[30] Foreign Application Priority Data

Jun. 18, 1984 [CA] Canada ..... 456835

[51] Int. Cl.[4] ..... D65B 3/04

[52] U.S. Cl. ..... 141/382; 141/384; 141/392; 141/1; 5/451

[58] Field of Search ..... 5/451; 285/162, 208–210, 285/319, 921, 13, 14, 365, 386; 141/1, 382–386, 389, 392, 65, 285, 289, 310, 313, 98

[56] References Cited

U.S. PATENT DOCUMENTS

| | | | |
|---|---|---|---|
| 2,951,714 | 9/1960 | Carlberg | 285/162 X |
| 3,494,643 | 2/1970 | Longshaw et al. | 285/238 X |
| 3,797,538 | 3/1974 | Mollura | 141/313 |
| 4,010,786 | 3/1977 | Aguettant et al. | 141/313 X |
| 4,212,335 | 7/1980 | Bova | 141/382 |
| 4,316,489 | 2/1982 | Price | 141/1 |
| 4,332,044 | 6/1982 | Houk, Jr. | 5/453 |
| 4,386,638 | 6/1983 | Hall et al. | 141/98 |

*Primary Examiner*—Stephen Marcus
*Assistant Examiner*—Ernest G. Cusick

[57] ABSTRACT

A waterbed filling unit has an outer sleeve which can be inserted into a waterbed filler neck and also coupled to a water supply or drain. An inner sleeve may be pressed into the outer sleeve to create watertight seals between the water supply or drain and the filler neck.

16 Claims, 4 Drawing Figures

INTERNAL EXPANSION WATERBED FITTING

This invention relates to means for coupling a water supply or water sump to the filler neck of a waterbed for filling or emptying the latter.

The filling means of the waterbed provides a male-threaded neck for coupling to the water supply. Prior coupling means, such as those shown in Canadian Pat. No. 1,083,634 dated Aug. 12, 1980 utilize such male threaded neck to couple the neck to the water supply.

This invention operates on a different principle and does not utilize the male threaded neck, rendering the threading superfluous. The invention provides an expandable outer sleeve member for insertion in the bore of the filler neck and an inner sleeve designed for insertion in the bore of the outer sleeve member when the latter is inserted in the bore of the filler neck. The inner and outer sleeve members are designed, so that, with said outer sleeve inserted in said neck, insertion of said inner sleeve into said outer sleeve expands said outer sleeve to cause it to make a seal with the neck of the waterbed and at the same time form a seal between the outer sleeve and the inner sleeve. Water may then be supplied to or withdrawn from the bed through the bore in the inner sleeve. Such seals prevent leakage of water during the filling or emptying operation. The inner sleeve member is provided with means for connection to a water supply or drain for filling or emptying said waterbed.

The coupling provided by the invention is substantially leakproof and more convenient and economical than the prior devices utilizing the male threading on the waterbed neck.

Preferred embodiments of the inventive coupling provide means for removably fixing the outer sleeve in place for the filling operation and for positioning the inner sleeve in position relative thereto for such filling operation. Preferred embodiments of the inventive coupling, in another aspect, provide means operable at an partial installation location of the inner sleeve relative to the outer sleeve to allow connection from the inside of the waterbed to atmosphere to allow release of trapped air therefrom. The design of the sleeve members is such that such connection is closed on rotation of the fully inserted outer sleeve relative to the inner for the filling operation.

In drawings which illustrate a preferred embodiment of the invention:

Figure 1:
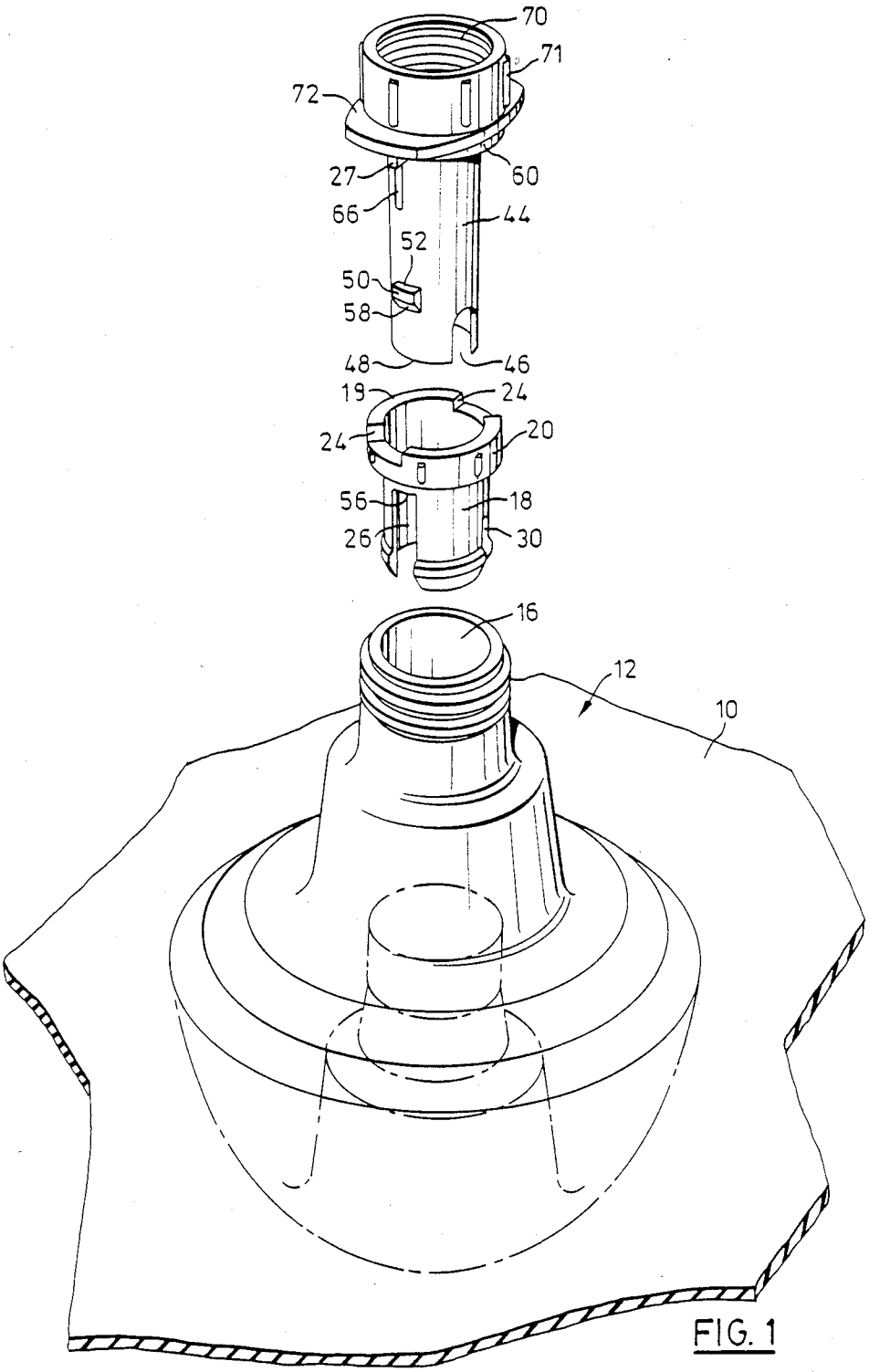
FIG. 1 is a perspective exploded view of the coupling in accord with the invention.
Figure 3:
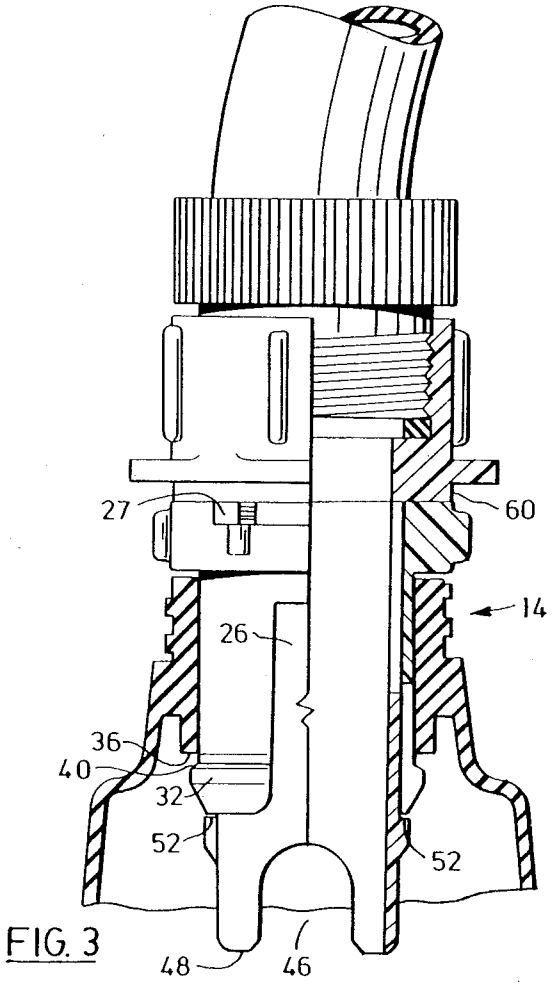
FIG. 3 is a side view, partially in section of the coupling device applied to a waterbed after sealing insertion and rotation of the inner sleeve.
Figure 2:
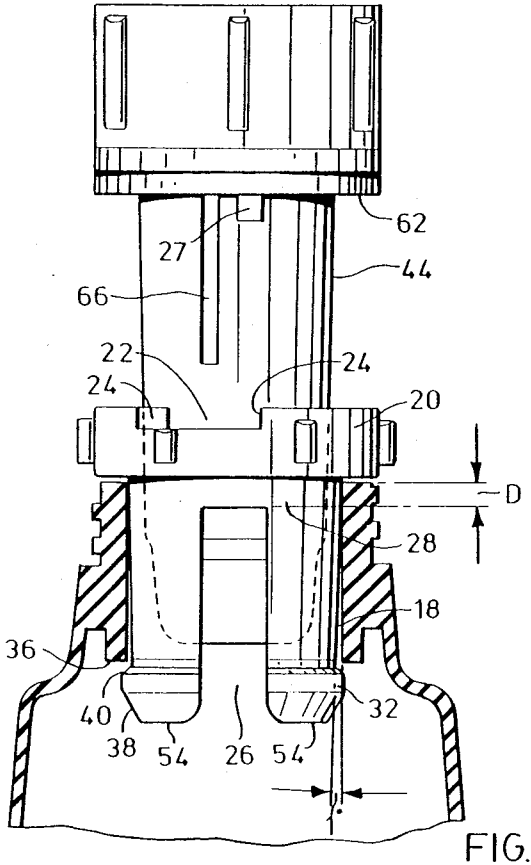
FIG. 2 is a side view of the coupling device applied to a water-bed before sealing insertion of the inner sleeve.
Figure 4:
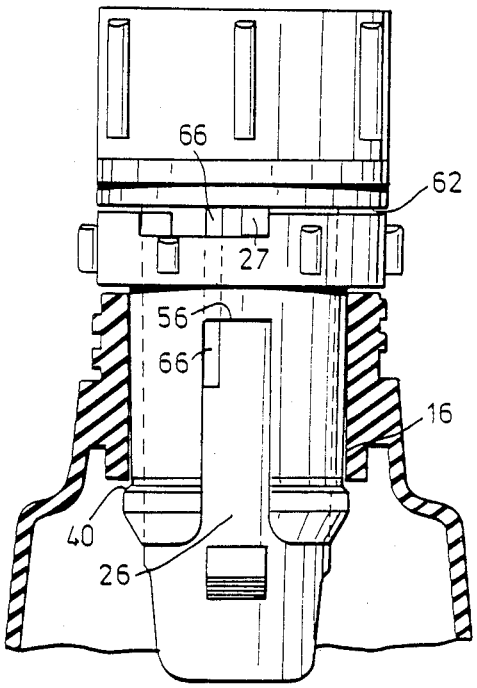
FIG. 4 is a side view similar to FIG. 2 but having the inner sleeve member oriented to vent the air inside the waterbed to atmosphere.

In the drawings 10 indicates the waterbed to which the neck 12 is attached. As the drawing shows neck 12 will customarily be able to assume either an extended or a retracted position relative to the waterbed. As shown neck 12 is provided with male threading 14 and, as shown in FIGS. 2–4 the neck has a substantially cyclindrical inner bore wall 16. An outer sleeve comprises a slightly conical outer wall 18 tapering about 1° in the insertion direction (the taper is exaggerated for the purposes of illustration). Outward of the tapering wall, the outer sleeve has an outwardly projecting flange 20 designed to seal on the outer surface of the waterbed neck. The inner and outer ends of the outer sleeve are sometimes referred to a leading and trailing ends, respectively, by virtue of their position relative to the insertion direction and operation. The trailing surface 19 of the flange is recessed at 22 in the leading direction over a predetermined arc of about 50° in diametrically opposed portions of the flange for a purpose to be hereafter specified.

It will be noted that each end of a recess is formed to provide shoulders 24 whose surface will act as peripherally directed stops to a projection 27 on the inner sleeve, to be hereafter described.

The widest and trailing portion of the outer surface of wall 18 is dimensioned to make a relatively close sliding fit with the inner surface 16 of the neck.

The leading end of the sleeve is provided with diametrically opposed slots 26 running from and opening to the leading end, running toward the trailing edge but stopping a designed distance short of the leading edge of flange 20 to leave a circumferential band of depth D opposite surface 16 in the inserted position of the outer sleeve. The surface 28 of the outer sleeve over extent D represents the sealing surface for making sealing contact with the inner surface of the filling neck. Midway between slots 26 thinner slots 30 extend open onto the leading edge of outer sleeve and extend a distance (shorter than slots 26) toward the trailing edge of the outer sleeve.

The outer sleeve is provided at its leading end with an outward projecting abutment 32 designed to rest beneath inner end 36 of filler neck when flange 20 is resting against the outer end of the neck to position the inner sleeve in its inserted position in the filter neck. It will be noted that the widest extent of abutment 36 is provided on its leading side with inward tapering surface 38 and on its trailing side with inward tapering surface 40. The leading and trailing surfaces assist on inward deflection of the abutment and adjacent portions of the outer sleeve member to allow the latter's inner and outer travel through the neck. The slots 26 and 30 assist the outer sleeve to achieve such deflection. The slots 26 also serve a further purpose as hereafter described.

The inner sleeve member has an extended outer surface 44 with the same 1° taper as the inner and the outer surface 18 of the outer sleeve. The inner sleeve has a pair of opposed wide slots 46 opening to the leading edges 48 which prevent sealing off of the bore in the inner sleeve should the leading end 48 thereof press against a surface of the waterbed.

The leading portion of the inner sleeve is also provided on its outer surface with a pair of outwardly projecting abutments 50. Such abutments have a width to slide in slots 26 and are provided with a surface 52 facing and perpendicular to the trailing direction. Such surfaces contact the leading surface 54 of the outer sleeve on full insertion and rotation of the inner sleeve in relation thereto. Such surfaces 52 also catch on the inner sleeve surface 56 at the root of slot 26 to retain the inner and outer sleeves together when the coupling is withdrawn and removed from the neck. The leading surface of the abutment 50 is chamferred inward at 58 in the leading direction. This allows easy insertion of the inner sleeve in the outer at the time of assembly by a slight deflection of one or both the inner and the outer sleeve members. Both the inner and the outer sleeve members are preferably made of molded plastic, preferably polyurethane or polypropylene having the necessary flexibility and the outer sleeve member, constructed of this material, will have sufficient stretchability to achieve the seal with the filler neck at band D when wedged outwardly by the inner sleeve.

The inner sleeve has an outwardly extending flange 60 with a leading surface 62 designed to rest on the trailing surface of the outer sleeve. The abutment surface 52 is located to bear on the leading surface 54 of the outer sleeve member when flange surface 62 is bearing on the trailing surface of the outer sleeve, thus fixing the inner sleeve firmly in leading-trailing position relative to the outer when the inner sleeve is inserted as far as allowed by its flange 60 and then rotated in the clockwise downward direction to the position of FIG. 3.

The orientation of the inner sleeve relative to the outer is controlled by projection 27 projecting radially outward from the surface of the inner sleeve and designed to ride on the bottom of recess 22 when flange 60 is riding on the flange 20 and surface 52 on the leading surface 54 of the outer sleeve member. As shown in FIG. 4 projection 27 at its counterclockwise downward limit of movement, aligns abutment 50 with slot 26 when the inner sleeve in its lowest position is to be moved upwardly relative to the outer. Projection 27 at its downward limiting position (that of FIG. 3) locates the inner sleeve in position with abutment 50 displaced away from slot 26 and with surface 52 bearing upward on the leading surface 54 of the outer sleeve.

A slot 66 in the wall of the inner sleeve extends longitudinally i.e. in the leading-trailing direction from flange 60 to a position communicating with both slot 26 in the outer sleeve and with the recess 22 thereof in the counterclockwise limiting position of the inner sleeve and with flange 60 resting on flange 20. It will be noted that the combined effect of slot 26, slot 66 and recess 22 is to provide a fluid connection from the inside of the waterbed to the outside atmosphere when the inner sleeve is in its counterclockwise orientation. It will further be noted that projection 27 and slot 66 are so located relative to each other that slot 66 does not communicate with slot 26 in the clockwise limiting position of inner sleeve so that communication between the waterbed and the outside atmosphere is then cut off.

In operation the inner and outer sleeve are assembled as a unit by deforming one or both of these members so that abutment 50 may be moved into slot 26 after which the sleeve members are permanently attached. The female threaded connection 70 at the trailing end of the inner sleeve is attached to a water hose connection not shown. The outer sleeve is then inserted into the waterbed by flexing in the leading extremities so that abutments 32 can pass through the filler neck and the abutments 32 can snap outward to bear on the leading surface 36 of the waterbed neck, while flange 20 bears on the neck's outer surface. The outer sleeve is then fixed in position.

The inner sleeve is then moved in the leading direction through the outer sleeve until flange 60 bears on the outer sleeve flange 20 and projection 27 bears on the root of the recess at which time surface 52 on abutment 50 is located to slide on the leading surface of the outer sleeve. The position is now as shown in FIG. 4. The outward pressure of the inner sleeve has now sealed the inner sleeve to the outer and the outer sleeve to the filler neck at the area marked 'D'. The inner sleeve is then rotated clockwise to the position of FIG. 3 as controlled by projection 27 so that the waterbed may be filled or drained depending on the connection of the water hose. In the position of FIG. 3, slot 66 does not connect the inside of the waterbed to the atmosphere since it does not in this orientation register with slot 26. From time to time, particularly during the filling operation it is desirable to eliminate air which has become trapped in the waterbed. This may be performed by rotating the inner sleeve from the position of FIG. 3 to the position of FIG. 4. Slot 66 now establishes connection between the inside of the waterbed and the atmosphere. The user may then press gently on selected areas of the waterbed to guide air out of the bed through the slot being careful not to spill water in the process. Normally before filling is recommenced, the inner sleeve is returned to the clockwise position of FIG. 3 to close the groove.

The six outwardly directed splines 71 on each of the inner and outer sleeve flanges are merely to allow easy manual maniputation. The truncated oval flange 72 on the inner sleeve is merely to assist in manipulation and to give a visual indication of the orientation of the outer sleeve member.

It will be obvious that the slot 66 may be replaced by an outwardly facing groove having a similar connecting function. However, the slot is easier to make.

We claim:

1. Waterbed filling unit:

for use with a waterbed having a filler neck with a an outer sleeve member for insertion in the bore of the filler neck of a waterbed, outer sleeve member having a leading and a trailing end relative to the insertion direction and being expandable transversely relative to said insertion direction, an inner sleeve member designed for insertion into the bore of said outer sleeve member when the latter is located in the bore of said filler neck, said inner and outer sleeve members being designed and dimensioned so that on said insertion of said inner sleeve member into said outer sleeve member, said outer sleeve member is expanded outwardly to form a seal with said filler neck; and so that a seal is formed between said inner and outer sleeve members, said outer sleeve member having means for coupling its outer end to a water supply or drain.

2. Waterbed filling unit as claimed in claim 1 wherein said outer sleeve member is provided with an outer surface designed to be inserted in sliding contact with said filler neck and said outer sleeve member is constructed of material expandable to form a seal with said filler neck, said inner and outer sleeves being so designed that on insertion of said inner sleeve member into said outer sleeve member, said outer sleeve member is expanded to form said seal with said filler neck.

3. Waterbed filling unit as claimed in claim 2 wherein said outer sleeve member is provided with retaining means at its leading end for insertion in said waterbed, said retaining means being shaped to engage the end of said filler neck inside said waterbed on insertion therein to retain said outer sleeve member in position for said filling operation and means allowing disengagement of said retaining means when said filling operation is concluded.

4. Waterbed filling unit as claimed in claim 3 wherein at least one slot is provided in said outer sleeve opening at the leading end and running a predetermined distance toward the trailing end but stopping short thereof to define a band between the trailing end of said slot and the trailing end of said sleeve wherein said inner sleeve member is designed and dimensioned relative to said outer sleeve member so that said inner sleeve member exerts outward pressure on said band to seal thereto and to cause the outer surface of said band to seal to said filler neck for forming said seal with said filler neck.

5. Waterbed filling unit as claimed in claim 4 wherein said inner sleeve member is provided with an outward projecting abutment designed to ride in said at least one slot, the insertion of said inner sleeve in said outer sleeve causing said seal between said outer sleeve and said filler neck and said seal between said inner and outer sleeve member when said abutment has cleared the leading edge of said outer sleeve, whereby said inner sleeve may then be rotated relative to said outer sleeve to lock said inner sleeve in position.

6. Waterbed filler as claimed in claim 5 wherein means provided in said inner and outer sleeves are designed to allow communication between the inside of said waterbed and the outside before rotation of said outer sleeve but to prevent such communication after said rotation.

7. Waterbed filling unit as claimed in claim 2 wherein at least one slot is provided in said outer sleeve opening at the leading end and running a predetermined distance toward the trailing end but stopping short thereof to define a band between the trailing end of said slot and the trailing end of said sleeve wherein said inner sleeve member is designed and dimensioned relative to said outer sleeve member so that said inner sleeve member exerts outward pressure on said band to seal thereto and to cause the outer surface of said band to seal to said filler neck for forming said seal with said filler neck.

8. Waterbed filling unit as claimed in claim 7 wherein said inner sleeve member is provided with an outward projecting abutment designed to ride in said at least one slot, the insertion of said inner sleeve in said outer sleeve causing said seal between said outer sleeve and said filler neck and said seal between said inner and outer sleeve members when said abutment has cleared the leading edge of said outer sleeve, whereby said inner sleeve may then be rotated relative to said outer sleeve to lock said inner sleeve in position.

9. Waterbed filler as claimed in claim 8 wherein means provided in said inner and outer sleeves are designed to allow communication between the inside of said waterbed and the outside before rotation of said outer sleeve but to prevent such communication after said rotation.

10. Waterbed filling unit as claimed in claim 1 wherein said outer sleeve member is provided with retaining means at its leading end for insertion in said waterbed, said retaining means being shaped to engage the end of said filler neck inside said waterbed on insertion therein to retain said outer sleeve member in position for said filling operation and means allowing disengagement of said retaining means when said filling operation is concluded.

11. Waterbed filling unit as claimed in claim 10 wherein at least one slot is provided in said outer sleeve opening at the leading end and running a predetermined distance toward the trailing end but stopping short thereof to define a band between the railing end of said slot and the trailing end of said sleeve wherein said inner sleeve member is designed and dimensioned relative to said outer sleeve member so that said inner sleeve member exerts outward pressure on said band to seal thereto and to cause the outer surface of said band to seal to said filler neck for forming said seal with said filler neck.

12. Waterbed filling unit as claimed in claim 11 wherein said inner sleeve member is provided with an outward projecting abutment designed to ride in said at least one slot, the insertion of said inner sleeve in said outer sleeve causing said seal between said outer sleeve and said filler neck and said seal between said inner and outer sleeve members when said abutment has cleared the leading edge of said outer sleeve, whereby said inner sleeve may then be rotated relative to said outer sleeve to lock said inner sleeve in position.

13. Waterbed filler as claimed in claim 12 wherein means provided in said inner and outer sleeves are designed to allow communication between the inside of said waterbed and the outside before rotation of said outer sleeve but to prevent such communication after said rotation.

14. Waterbed filling unit as claimed in claim 1 wherein at least two slots are provided in said outer sleeve opening to the leading end and running a predetermined distance toward the trailing end but stopping short thereof to define a band between the trailing end of said slot and the trailing end of said sleeve wherein said inner sleeve member is designed and dimensioned relative to said outer sleeve member so that said inner sleeve member exerts outward pressure on said band to seal thereto and to cause the outer surface of said band to seal to said filler neck for forming said seal with said filler neck.

15. Waterbed filling unit as claimed in claim 14 wherein said inner sleeve member is provided with an outward projecting abutment designed to ride in said at least one slot, the insertion of said inner sleeve in said outer sleeve causing said seal between said outer sleeve and said filler neck and said seal between said inner and outer sleeve members when said abutment has cleared the leading edge of said outer sleeve, whereby said inner sleeve may then be rotated relative to said outer sleeve to lock said inner sleeve in position.

16. Waterbed filler as claimed in claim 15 wherein means provided in said inner and outer sleeves are designed to allow communication between the inside of said waterbed and the outside before rotation of said outer sleeve but to prevent such communication after said rotation.

* * * * *